US011598346B2

(12) United States Patent
Hashiguchi et al.

(10) Patent No.: US 11,598,346 B2
(45) Date of Patent: Mar. 7, 2023

(54) WATER PUMP

(71) Applicant: AISIN CORPORATION, Kariya (JP)

(72) Inventors: Itsuro Hashiguchi, Kariya (JP); Kenichi Komai, Kariya (JP)

(73) Assignee: AISIN CORPORATION, Aichi (JP)

( * ) Notice: Subject to any disclaimer, the term of this patent is extended or adjusted under 35 U.S.C. 154(b) by 0 days.

(21) Appl. No.: 17/125,013

(22) Filed: Dec. 17, 2020

(65) Prior Publication Data

US 2021/0190085 A1 Jun. 24, 2021

(30) Foreign Application Priority Data

Dec. 23, 2019 (JP) ..... JP2019-232151

(51) Int. Cl.
*F04D 29/12* (2006.01)
*F04D 29/046* (2006.01)
*F01P 5/10* (2006.01)

(52) U.S. Cl.
CPC ..... *F04D 29/126* (2013.01); *F04D 29/046* (2013.01); *F01P 5/10* (2013.01); *F05B 2260/603* (2013.01)

(58) Field of Classification Search
CPC ..... F04D 13/16; F04D 13/022; F04D 29/046; F04D 29/049; F04D 29/126; F04D 29/467; F04D 29/426; F01P 5/10; F05B 2260/603; F05D 2260/6022
See application file for complete search history.

(56) References Cited

U.S. PATENT DOCUMENTS 6,793,459 B2 * 9/2004 Chujo ..... F04D 29/426 415/214.1
9,777,740 B2 * 10/2017 Chiba ..... F04D 29/126
2003/0175118 A1 9/2003 Chujo et al.
2008/0112792 A1 * 5/2008 Hotta ..... F04D 29/708 123/41.44
2013/0064648 A1 3/2013 Chiba et al.

FOREIGN PATENT DOCUMENTS

GB 2390398 A * 1/2004 ..... F04D 29/126
JP 2003269165 A 9/2003
JP 2007016629 A * 1/2007
JP 2011247179 A 12/2011
JP 2014227984 A 12/2014
JP 6003094 B2 * 10/2016

* cited by examiner

*Primary Examiner* — Brian P Wolcott
(74) *Attorney, Agent, or Firm* — Buchanan Ingersoll & Rooney PC

(57) ABSTRACT

In a water pump, a water reservoir portion into which cooling water leaking from between a bearing portion and a rotating shaft flows via an introduction hole is divided into a first division portion and a second division portion by a gasket. The first division portion and the second division portion communicate with each other through a communication hole formed in the gasket. The second division portion includes a drain hole through which cooling water is discharged to outside.

10 Claims, 7 Drawing Sheets

WATER PUMP

CROSS REFERENCE TO RELATED APPLICATIONS

This application is based on and claims priority under 35 U.S.C. § 119 to Japanese Patent Application 2019-232151, filed on Dec. 23, 2019, the entire content of which is incorporated herein by reference.

TECHNICAL FIELD

This disclosure generally relates to a water pump.

BACKGROUND DISCUSSION

A water pump including a water reservoir portion that stores cooling water leaking to an outside of an internal combustion engine from a pump chamber has been conventionally known (for example, see JP2014-227984A (Reference 1)).

Reference 1 discloses a water pump including a driving shaft, a rotor, a housing, a pump chamber constituent member, a seal member, a water reservoir portion, and a drain hole. The housing and the pump chamber constituent member constitute a pump chamber. The rotor is housed in the pump chamber, and cooling water is discharged by the rotor being rotated by the driving shaft. The seal member that suppresses leakage of the cooling water is provided in a gap between the driving shaft and the housing, but a part of the cooling water leaks to an outside of an internal combustion engine from the pump chamber.

Since there is a risk that the leaking cooling water being visually recognized may be mistaken for a failure of the water pump, the water reservoir portion that temporarily stores the leaking cooling water is provided. The cooling water stored in the water reservoir portion evaporates by heat of the internal combustion engine. When an amount of the leaking cooling water exceeds an amount of evaporation, the cooling water is discharged to an outside of the internal combustion engine through the drain hole provided in the water reservoir portion.

However, the drain hole provided in the water reservoir portion is open to the atmosphere in the water pump in Reference 1, and thus there is a problem that outside air including foreign matter flows backward through the drain hole, the foreign matter reaches the seal member, and a sealing property deteriorates.

A need thus exists for a water pump which is not susceptible to the drawback mentioned above.

SUMMARY

A water pump that solves the problem described above includes a body on which a bearing portion is formed, a fixing member to which the body is fixed via a gasket, a pump chamber formed by the body and the fixing member, a rotating shaft rotatably supported by the bearing portion, a seal member provided between the rotating shaft and the body, an impeller provided on one end of the rotating shaft and housed in the pump chamber, a pulley that is provided on another end of the rotating shaft, and rotates the rotating shaft, and a water reservoir portion that is formed by the body and the fixing member, and into which cooling water leaking from between the bearing portion and the rotating shaft flows via an introduction hole. The water reservoir portion is divided into a first division portion and a second division portion by the gasket. The first division portion and the second division portion communicate with each other through a communication hole formed in the gasket. The second division portion includes a drain hole through which cooling water is discharged to outside.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

First Embodiment

Figure 1:
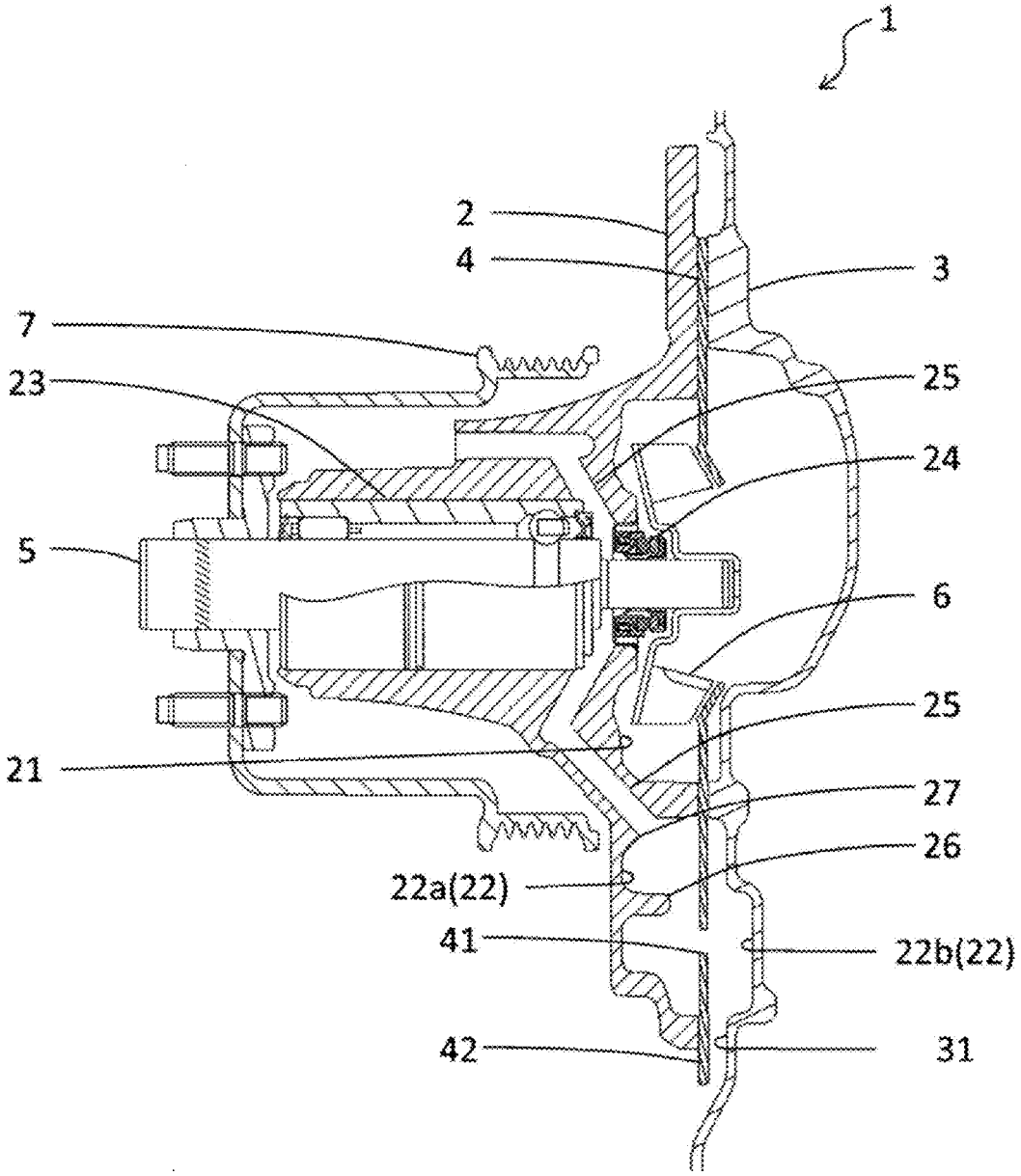
FIG. 1 is a cross-sectional view illustrating one example of a configuration of a water pump according to a first embodiment.
Figure 2:
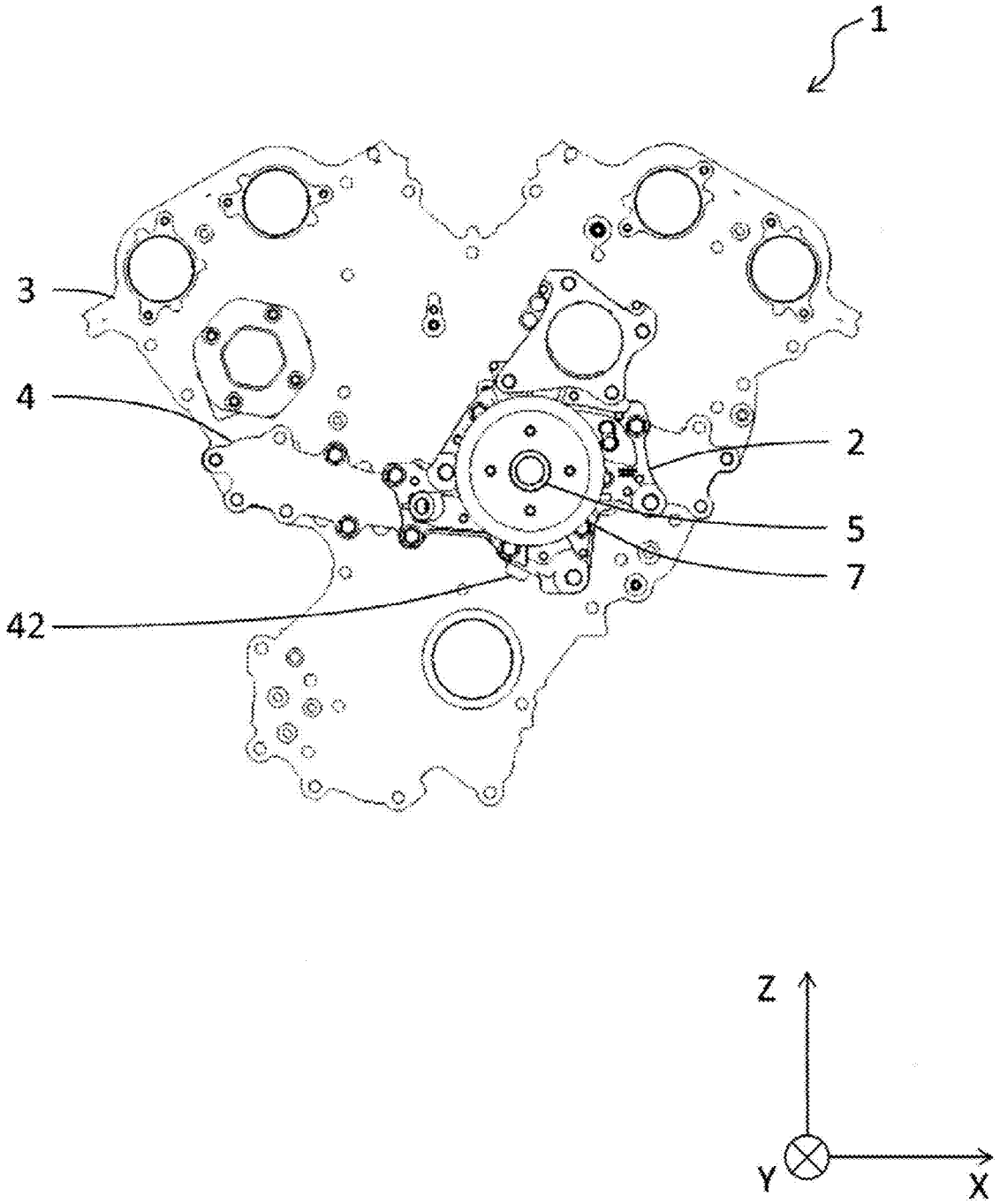
FIG. 2 is a front view illustrating one example of the configuration of the water pump according to the first embodiment.
Figure 3:
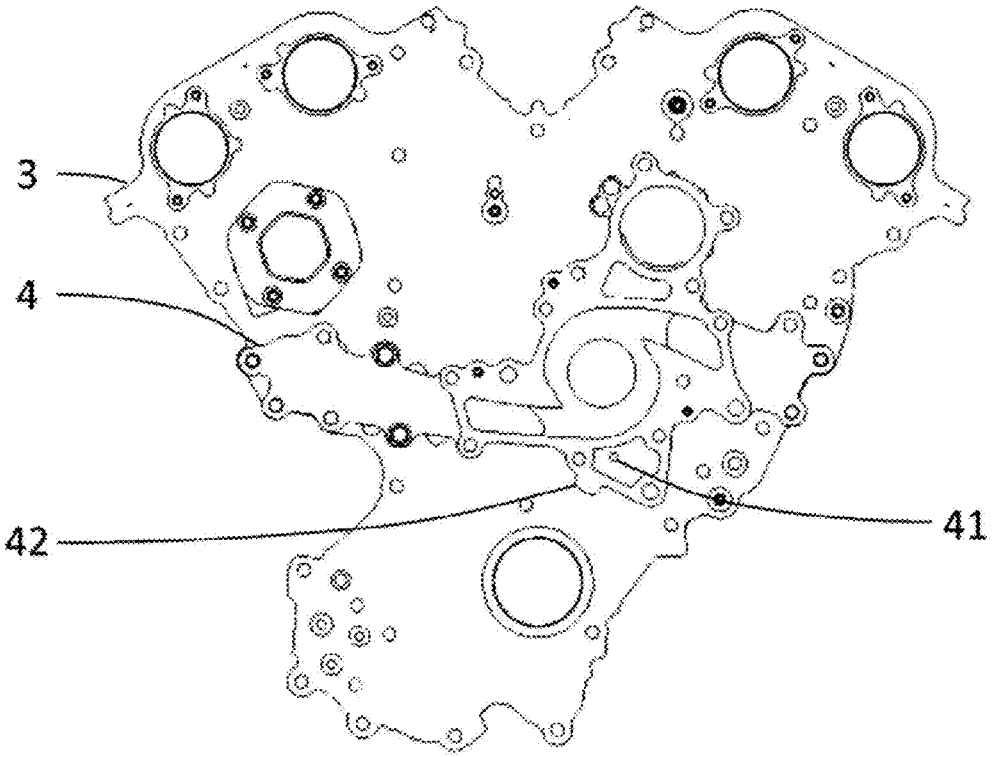
FIG. 3 is a front view illustrating one example of a configuration of a gasket and a fixing member according to the first embodiment.
Figure 3:
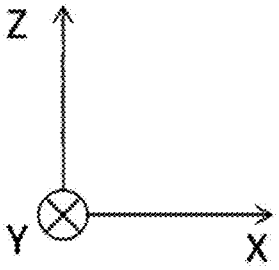
Figure 4:
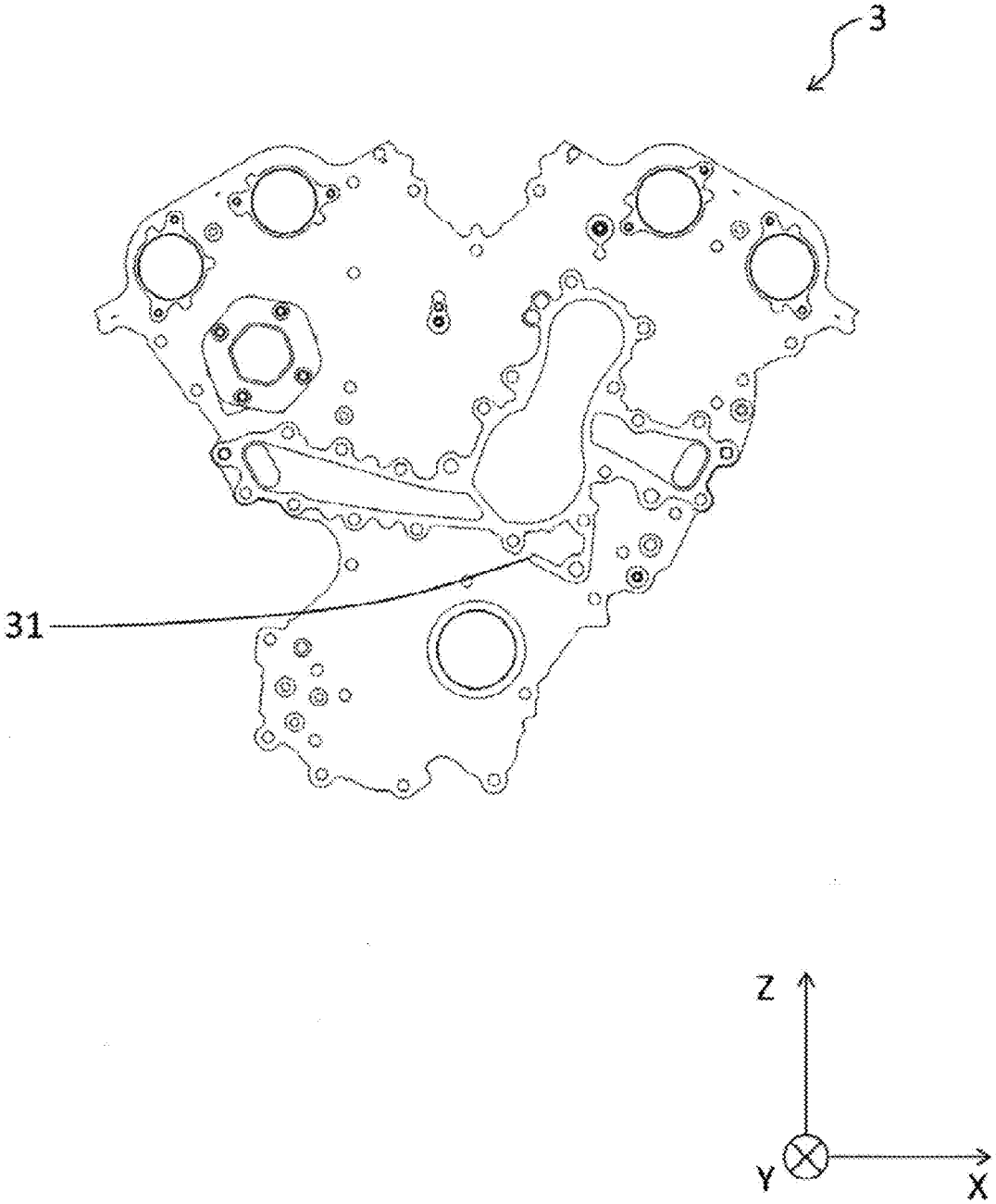
FIG. 4 is a front view illustrating one example of the configuration of the fixing member according to the first embodiment.
Figure 5:
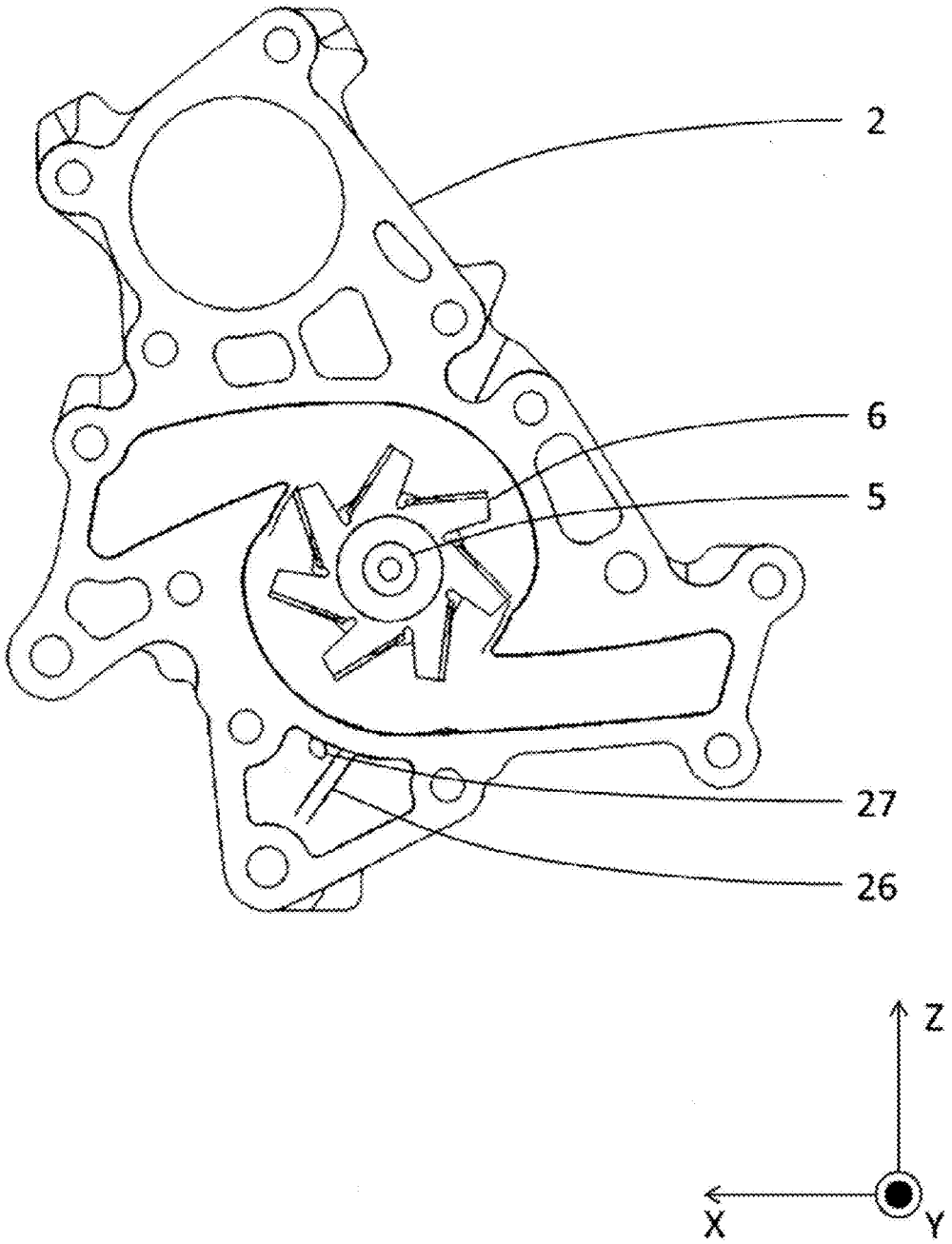
FIG. 5 is a rear view illustrating one example of a configuration of a body and an impeller according to the first embodiment.

FIG. 1 is a cross-sectional view illustrating one example of a configuration of a water pump 1 according to a first embodiment. FIG. 2 is a front view illustrating one example of the configuration of the water pump 1 according to the first embodiment. FIG. 3 is a front view illustrating one example of a configuration of a gasket 4 and a fixing member 3 according to the first embodiment. FIG. 4 is a front view illustrating one example of the configuration of the fixing member 3 according to the first embodiment. FIG. 5 is a rear view illustrating one example of a configuration of a body 2 and an impeller 6 according to the first embodiment.

The water pump 1 according to the present embodiment circulates cooling water through an engine (not illustrated) and a radiator (not illustrated) of a vehicle, causes the cooling water to absorb heat generated in the engine, and discharges the heat of the cooling water in the radiator, and thus cools the engine.

The water pump 1 includes the body 2, the fixing member 3, the gasket 4, a rotating shaft 5, the impeller 6, and a pulley 7.

The body 2 and the fixing member 3 are coupled to each other with the gasket 4 interposed therebetween, and form a contour of the water pump 1, and a pump chamber 21 and a water reservoir portion 22. The pump chamber 21 houses the impeller 6 therein. The impeller 6 rotates in the pump chamber 21, and thus the cooling water is circulated.

The body 2 includes a bearing portion 23 and a seal member 24. The bearing portion 23 is constituted by a bearing, has an outer circumference being fixed to the body 2, and has an inner circumference in which the rotating shaft 5 is press-fitted. The seal member 24 suppresses leakage of the cooling water from the pump chamber 21 through a gap between the rotating shaft 5 and the body 2. When the cooling water leaks, the cooling water passes through a drain path 25 between the seal member 24 and the bearing portion 23, and is stored in the water reservoir portion 22. The drain path 25 is connected to the outside of the water pump 1 in an upper portion in a vertical direction of the body 2.

The rotating shaft 5 is press-fitted in the bearing portion 23. One end of the rotating shaft 5 is connected to the impeller 6 housed in the pump chamber 21 and integrally rotates. The other end of the rotating shaft 5 is connected to the pulley 7 and integrally rotates by a crank shaft (not illustrated).

The water reservoir portion 22 is connected to the drain path 25 through an introduction hole 27, and stores the cooling water slightly leaking from the pump chamber 21. The stored cooling water evaporates by the heat generated in the engine, and is discharged to the outside of the water pump 1 via the drain path 25. When the leaking cooling water exceeds an upper limit of the amount of water storage, the cooling water is discharged to the outside of the water pump 1 via a drain hole 31 provided in the fixing member 3.

The water reservoir portion 22 is divided into a first division portion 22*a* and a second division portion 22*b* by the gasket 4.

The first division portion 22*a* is formed by the body 2 and the gasket 4. The first division portion 22*a* is connected to the drain path 25, and stores the cooling water leaking from the pump chamber 21. The first division portion 22*a* communicates with the second division portion 22*b* through a communication hole 41 provided in the gasket 4. When the cooling water overflows the first division portion 22*a*, the cooling water is stored in the second division portion 22*b* via the communication hole 41. The communication hole 41 is formed in an upper portion in the vertical direction of the gasket 4. In this way, the amount of water storage of the first division portion 22*a* can be increased. Further, a blockage of the communication hole 41 due to accumulation of foreign matter included in the cooling water or outside air on a bottom portion of the water reservoir portion 22 can be suppressed.

The second division portion 22*b* is formed by the gasket 4 and the fixing member 3. The second division portion 22*b* communicates with the outside of the water pump 1 through the drain hole 31 provided in the fixing member 3. The second division portion 22*b* stores the cooling water overflowing the first division portion 22*a*. The drain hole 31 is formed in an upper portion in the vertical direction of the fixing member 3. In this way, the amount of water storage of the second division portion 22*b* can be increased. Further, a blockage of the drain hole 31 due to accumulation of foreign matter included in the cooling water or the outside air on a bottom portion of the second division portion 22*b* can be suppressed.

By dividing the water reservoir portion 22 into the first division portion 22*a* and the second division portion 22*b* by the gasket 4, a flow path resistance occurs during passage through the communication hole 41, and thus backflow of the outside air including foreign matter from the drain hole 31 can be suppressed. By suppressing backflow, foreign matter reaching the seal member 24 and deterioration of a sealing property can be suppressed. Further, a distance in which the cooling water runs down a wall surface from the introduction hole 27 to the drain hole 31 is increased. In this way, leakage of the cooling water to the outside due to capillarity occurring in the wall surface from the communication hole 41 to the drain hole 31 can be suppressed.

The first division portion 22*a* includes a rib 26. The rib 26 is provided on the body 2, and protrudes toward the inside of the first division portion 22*a*. The rib 26 is disposed in such a way that a distance in which the cooling water runs down the wall surface from the introduction hole 25 to the drain hole 41 is increased. In this way, a distance in which the cooling water runs down the wall surface is increased, and leakage of the cooling water to the second division portion 22*b* due to capillarity can be suppressed. Note that, since capillarity occurs in any wall surface from the drain path 25 to the communication hole 41, the rib 26 may be provided anywhere on the wall surface of the first division portion 22*a*. Further, leakage of the cooling water to the outside due to capillarity occurring in the wall surface from the communication hole 41 to the drain hole 31 can be suppressed by providing the rib 26 on the second division portion 22*b*.

The gasket 4 includes an extending portion 42 that extends from between the body 2 and the fixing member 3 in such a way as to cover the drain hole 31. In this way, a flow path resistance occurs when the outside air flows backward through the drain hole 31 while avoiding the extending portion 42, and thus backflow can be suppressed and deterioration of a sealing property can be suppressed.

As described above, at least the following effect can be acquired according to the present embodiment.

- A flow path resistance occurs during passage through the communication hole 41 provided in the gasket 4, and thus backflow of the outside air including foreign matter from the drain hole 31 can be suppressed. By suppressing backflow, foreign matter reaching the seal member 24 and deterioration of a sealing property can be suppressed. Further, by dividing the water reservoir portion 22 into the first division portion 22*a* and a second division portion 22*b* by the gasket 4, a distance in which the cooling water runs down the wall surface from the introduction hole 27 to the drain hole 31 is increased. In this way, leakage of the cooling water to the outside due to capillarity occurring in the wall surface from the introduction hole 27 to the drain hole 31 can be suppressed.
- By providing the extending portion 42, a flow path resistance occurs when the outside air flows backward through the drain hole 31 while avoiding the extending portion 42, and thus backflow of the outside air can be suppressed and deterioration of a sealing property can be suppressed.
- The first division portion 22*a* includes the rib 26, and thus a distance in which the cooling water runs down the wall surface from the introduction hole 27 to the communication hole 41 is increased, and leakage of the cooling water due to capillarity can be suppressed.
- The communication hole 41 is formed in the water reservoir portion 22 diagonally with respect to the introduction hole 27, and thus a distance in which the cooling water runs down the wall surface from the introduction hole 27 to the communication hole 41 is increased, and capillarity can be suppressed.

The amount of water storage of the first division portion 22*a* or the second division portion 22*b* can be increased by providing the communication hole 41 or the drain hole 31 in the upper portion in the vertical direction of the water reservoir portion 22. Further, a blockage of the communication hole 41 or the drain hole 31 due to accumulation of foreign matter included in the cooling water or the outside air on the bottom portion of the water reservoir portion 22 can be suppressed.

Second Embodiment

Figure 6:
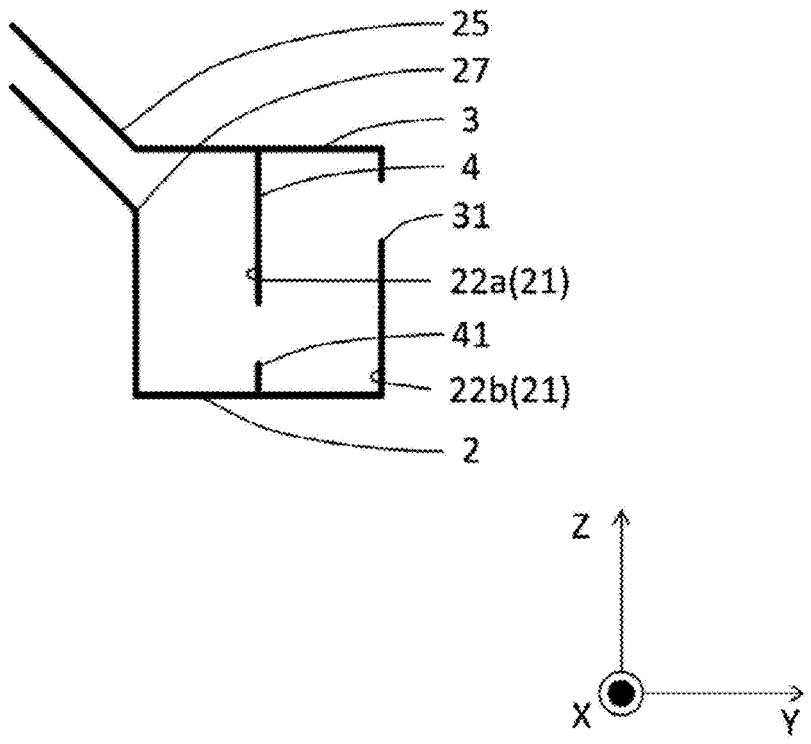
FIG. 6 is a schematic view illustrating one example of a characteristic of a water reservoir portion according to a second embodiment.

FIG. 6 is a schematic view illustrating one example of a characteristic of a water reservoir portion 22 according to a second embodiment.

In the second embodiment, only a configuration different from that in the first embodiment will be described. In the second embodiment, a relative positional relationship between a communication hole 41 and a drain hole 31 is different.

The communication hole 41 according to the present embodiment is formed in a lower portion in the vertical direction further than the drain hole 31. In this way, when the outside air flows backward from the drain hole 31 to the communication hole 41, a traveling direction of the outside air changes in the vertical direction, and thus a flow path resistance occurs, and backflow of the outside air can be further suppressed. Further, a first division portion 22*a* can secure the amount of water storage to a position of the drain hole 31 instead of the communication hole 41, and thus the amount of water storage can be greatly maintained by forming the drain hole 31 in an upper portion in the vertical direction.

Third Embodiment

Figure 7:
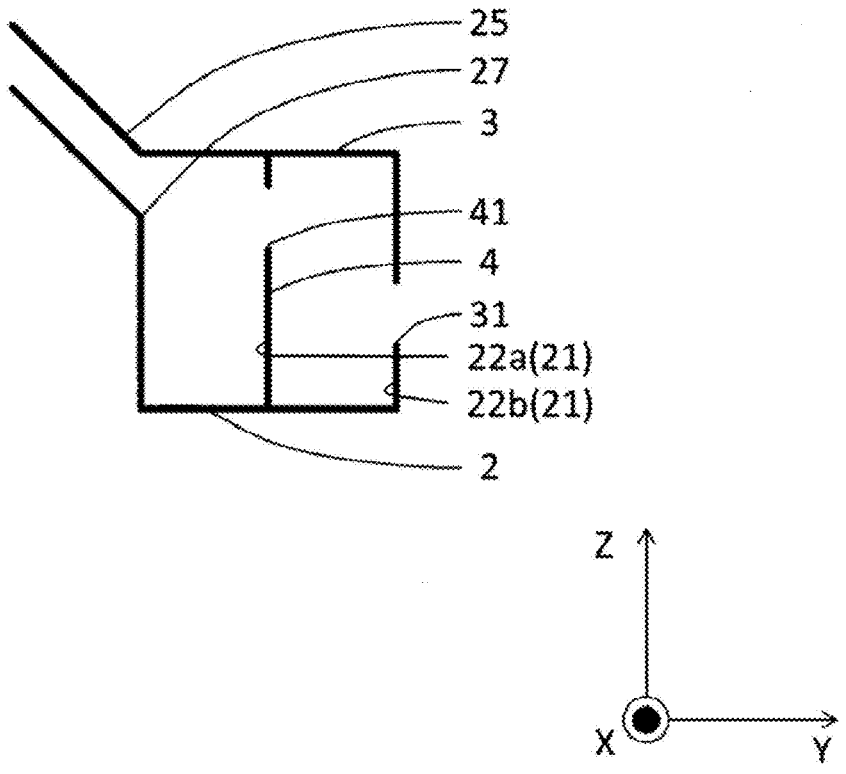
FIG. 7 is a schematic view illustrating one example of a characteristic of a water reservoir portion according to a third embodiment.

FIG. 7 is a schematic view illustrating one example of a characteristic of a water reservoir portion 22 according to a third embodiment.

In the third embodiment, only a configuration different from that in the first embodiment will be described. In the third embodiment, a relative positional relationship between a communication hole 41 and a drain hole 31 is different.

The communication hole 41 according to the present embodiment is formed in an upper portion in the vertical direction further than the drain hole 31. In this way, when the outside air flows backward from the drain hole 31 to the communication hole 41, a traveling direction of the outside air changes in the vertical direction, and thus a flow path resistance occurs, and backflow of the outside air can be further suppressed. Furthermore, when the leaking cooling water exceeds the amount of water storage of a first division portion 22*a*, the cooling water is discharged to the outside of a water pump 1 via a second division portion 22*b* and the drain hole 31, and thus the communication hole 41 is not blocked. The stored cooling water is discharged to the outside by evaporating, and, since the communication hole 41 is not blocked, the cooling water stored in the first division portion 22*a* and the second division portion 22*b* can evaporate from the drain hole 31 and an introduction hole 27, and evaporation efficiency can be improved. Note that a similar effect is also acquired when a relative position between the drain hole 31 and the communication hole 41 is set in such a way as to change a traveling direction of the outside air in a direction perpendicular to the vertical direction.

Fourth Embodiment

Figure 8:
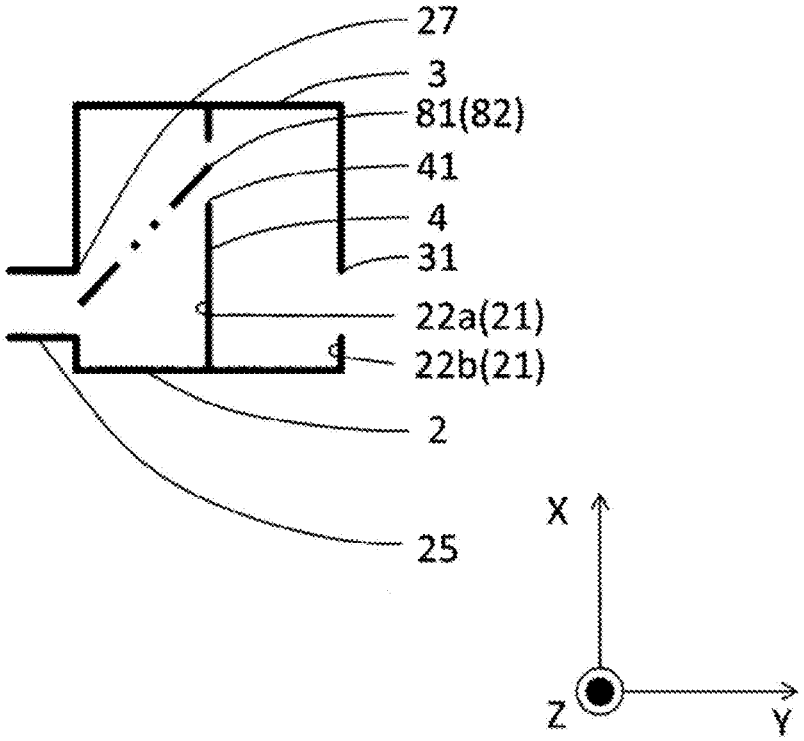
FIG. 8 is a schematic view illustrating one example of a characteristic of a water reservoir portion according to a fourth embodiment.

FIG. 8 is a schematic view illustrating one example of a characteristic of a water reservoir portion 22 according to a fourth embodiment.

In the fourth embodiment, only a configuration different from that in the first embodiment will be described. In the fourth embodiment, a relative positional relationship between an introduction hole 27 and a communication hole 41 is different.

In a vertical direction view, a virtual line 81 passing through a central point of the introduction hole 27 and a central point of the communication hole 41 is located on a virtual plane 82 that equally divides a capacity of a first division portion 22*a* into two.

In this way, a distance in which the cooling water runs down a wall surface from the introduction hole 27 to the communication hole 41 is increased the most. In this way, leakage of the cooling water to the outside due to capillarity occurring in the wall surface from the introduction hole 27 to the communication hole 41 can be suppressed. Note that a similar effect is also acquired in a positional relationship between the communication hole 41 and a drain hole 31 with a similar configuration. Note that a similar effect is also acquired when a relative position between the drain hole 31 and the communication hole 41 is set in a similar manner to the relative positional relationship between the introduction hole 27 and the communication hole 41.

A water pump that solves the problem described above includes a body on which a bearing portion is formed, a fixing member to which the body is fixed via a gasket, a pump chamber formed by the body and the fixing member, a rotating shaft rotatably supported by the bearing portion, a seal member provided between the rotating shaft and the body, an impeller provided on one end of the rotating shaft and housed in the pump chamber, a pulley that is provided on another end of the rotating shaft, and rotates the rotating shaft, and a water reservoir portion that is formed by the body and the fixing member, and into which cooling water leaking from between the bearing portion and the rotating shaft flows via an introduction hole. The water reservoir portion is divided into a first division portion and a second division portion by the gasket. The first division portion and the second division portion communicate with each other through a communication hole formed in the gasket. The second division portion includes a drain hole through which cooling water is discharged to outside.

According to the configuration described above, a flow path resistance occurs during passage through the communication hole provided in the gasket, and thus backflow of outside air including foreign matter from the drain hole can be suppressed. By suppressing backflow, foreign matter reaching the seal member from the outside and deterioration of a sealing property can be suppressed. Further, by dividing the water reservoir portion into the first division portion and the second division portion by the gasket, a distance in which the cooling water runs down a wall surface from the introduction hole to the drain hole is increased. In this way, leakage of the cooling water due to capillarity occurring on the wall surface from the introduction hole to the drain hole can be suppressed.

In the water pump described above, the gasket may include an extending portion that covers the drain hole.

According to the configuration described above, a flow path resistance occurs when the outside air flows backward through the drain hole while avoiding the extending portion, and thus backflow of the outside air can be further suppressed and deterioration of a sealing property can be suitably suppressed.

In the water pump described above, a rib may be provided on an inner wall of the water reservoir portion.

According to the configuration described above, a distance in which the cooling water runs down a wall surface from the introduction hole to the communication hole or from the communication hole to the drain hole is increased, and leakage of the cooling water due to capillarity can be suitably suppressed.

In the water pump described above, in a vertical direction view, a virtual line passing through a central point of the introduction hole and a central point of the communication hole may be located on a virtual plane that equally divides a capacity of the first division portion into two.

According to the configuration described above, a distance in which the cooling water runs down the wall surface from the introduction hole to the communication hole is increased, and leakage of the cooling water due to capillarity can be suitably suppressed.

In the water pump described above, the communication hole may be formed in a lower portion in a vertical direction further than the drain hole.

According to the configuration described above, when the outside air flows backward from the drain hole to the communication hole, a traveling direction of the outside air changes in the vertical direction, and thus a flow path resistance occurs, and backflow of the outside air can be further suitably suppressed. Further, the first division portion can secure an amount of water storage to a position of the drain hole instead of the communication hole, and thus the amount of water storage can be increased by forming the drain hole in an upper portion in the vertical direction.

In the water pump described above, the communication hole may be formed in an upper portion in a vertical direction further than the drain hole.

According to the configuration described above, when the outside air flows backward from the drain hole to the communication hole, a traveling direction of the outside air changes in the vertical direction, and thus a flow path resistance occurs, and backflow of the outside air can be further suitably suppressed. Furthermore, when the leaking cooling water exceeds an amount of water storage of the first division portion, the cooling water is discharged to an outside of the water pump via the second division portion and the drain hole, and thus the communication hole is not blocked. The stored cooling water is discharged to outside by evaporating. Since the communication hole is not blocked, the cooling water stored in the first division portion and the second division portion can evaporate from the drain hole and the introduction hole, and evaporation efficiency can be improved.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. A water pump, comprising:

a body on which a bearing portion is formed;

a fixing member to which the body is fixed via a gasket;

a pump chamber formed by the body and the fixing member;

a rotating shaft rotatably supported by the bearing portion;

a seal member provided between the rotating shaft and the body;

an impeller provided on one end of the rotating shaft and housed in the pump chamber;

a pulley that is provided on another end of the rotating shaft, and rotates the rotating shaft; and a water reservoir portion that is formed by the body and the fixing member, and into which cooling water leaking from between the bearing portion and the rotating shaft flows via an introduction hole, wherein the water reservoir portion is divided into a first division portion and a second division portion by the gasket, the first division portion and the second division portion communicate with each other through a communication hole formed in the gasket, the second division portion includes a drain hole through which cooling water is discharged to outside, and the gasket includes an extending portion that covers the drain hole.

2. The water pump according to claim 1, wherein a rib is provided on an inner wall of the water reservoir portion.

3. The water pump according to claim 1, wherein, in a vertical direction view, a virtual line passing through a central point of the introduction hole and a central point of the communication hole is located on a virtual plane that equally divides a capacity of the first division portion into two.

4. The water pump according to claim 2, wherein, in a vertical direction view, a virtual line passing through a central point of the introduction hole and a central point of the communication hole is located on a virtual plane that equally divides a capacity of the first division portion into two.

5. The water pump according to claim 1, wherein in a vertical direction view the communication hole is lower than the drain hole.

6. The water pump according to claim 2, wherein in a vertical direction view the communication hole is lower than the drain hole.

7. The water pump according to claim 3, wherein in the vertical direction view the communication hole is lower than the drain hole.

8. The water pump according to claim 1, wherein in a vertical direction view the communication hole is higher than the drain hole.

9. The water pump according to claim 2, wherein in a vertical direction view the communication hole is higher than the drain hole.

10. The water pump according to claim 3, wherein in the vertical direction view the communication hole is higher than the drain hole.

* * * * *